US010064459B1

(12) United States Patent
Cantas

(10) Patent No.: US 10,064,459 B1
(45) Date of Patent: Sep. 4, 2018

(54) PORTABLE DECORATIVE ELEMENT COMPRISING A LINING PINNED UNDER A RIGID OPENWORK STRUCTURE

(71) Applicant: ALTESSE, Saint-Martin-de-Valamas (FR)

(72) Inventor: Frederic Cantas, Elancourt (FR)

(73) Assignee: ALTESSE, Saint-Martin-de-Valamas (FR)

( * ) Notice: Subject to any disclaimer, the term of this patent is extended or adjusted under 35 U.S.C. 154(b) by 0 days.

(21) Appl. No.: 15/610,634

(22) Filed: Jun. 1, 2017

(30) Foreign Application Priority Data

Mar. 3, 2017 (FR) ..... 17 00221

(51) Int. Cl.

| | |
|---|---|
| ***A44C 15/00*** | (2006.01) |
| ***A44C 5/12*** | (2006.01) |
| ***A44C 9/00*** | (2006.01) |
| ***A44C 5/00*** | (2006.01) |

(52) U.S. Cl.
CPC ..... *A44C 5/0092* (2013.01); *A44C 5/0084* (2013.01)

(58) Field of Classification Search
CPC ... A44C 5/0084; A44C 5/0092; A44C 9/0053; A44C 9/0061; A44C 9/0084; A44C 5/003; A44C 5/0015; A44C 5/00
USPC ..... 40/633, 5, 639, 642.02, 649, 650, 653, 40/654.01, 491, 611.06, 611.07, 611.08; 428/542.2; 63/3, 33, 15, 15.5, 15.6, 15.7, 63/40
See application file for complete search history.

(56) References Cited

U.S. PATENT DOCUMENTS

| | | | | | |
|---|---|---|---|---|---|
| 56,618 | A * | 7/1866 | Sauter | A44C 9/00 | 144/195.2 |
| 152,789 | A * | 7/1874 | Annin | A44C 9/02 | 63/15.6 |
| 202,588 | A * | 4/1878 | Riker | A44C 9/00 | 29/896.412 |
| 1,060,229 | A * | 4/1913 | Casper et al. | A44B 11/001 | 2/300 |
| 2,128,644 | A * | 8/1938 | Gittler | A44C 9/0015 | 63/15 |
| 2,413,541 | A * | 12/1946 | Brady | A44C 5/0084 | 63/3 |
| 2,427,119 | A * | 9/1947 | Bensel | A41F 9/002 | 2/321 |
| 3,214,939 | A * | 11/1965 | Monahan | A44C 9/0084 | 446/901 |
| 5,701,838 | A * | 12/1997 | Ito | F16H 59/0213 | 116/28.1 |

(Continued)

FOREIGN PATENT DOCUMENTS

| | | | | |
|---|---|---|---|---|
| GB | 230986 A * | 3/1925 | ..... | A44C 5/0092 |

*Primary Examiner* — Jack W Lavinder
(74) *Attorney, Agent, or Firm* — Joseph G. Chu; JCIP

(57) ABSTRACT

Portable decorative element comprising a rigid structure (10) having decorative piercings (11), receiving on its rear face (12), in position of use, a lining (20) forming a plate visible through these piercings, capable of being bent in an elastic manner, characterized in that the rear face (12) of the rigid structure comprises at least two shoulders (14, 16) opposite to each other and against which, in position of use, the edges (21) of the lining (20) are pressed in an elastic and reversible manner in order to apply a tightening of this lining resulting in its pinning against the rear face of the structure.

17 Claims, 2 Drawing Sheets

(56) References Cited

U.S. PATENT DOCUMENTS

| | | | | |
|---|---|---|---|---|
| 6,481,244 | B1 * | 11/2002 | Wright | A44C 9/0092 63/15 |
| 2015/0359304 | A1 * | 12/2015 | Thomas | A44C 17/0208 63/1.11 |

* cited by examiner

PORTABLE DECORATIVE ELEMENT COMPRISING A LINING PINNED UNDER A RIGID OPENWORK STRUCTURE

This application claims priority to the French Patent Application No. 1700221 filed on Mar. 3, 2017, the content of which is incorporated in its entirety herein.

BACKGROUND OF THE INVENTION

The present invention relates to a portable decorative element associating several elements, being able to have different aspects and/or to be made of different materials.

Modern methods of cutting metal sheets make it possible to produce, from metals such as steel, brass, copper, aluminium, silver or gold, varied and fine cut-outs comprising in particular piercings of different shapes, to produce items of jewelry or fashion accessories.

It is known to fasten in a definitive manner on the inner face of the cut metal sheet a slightly flexible lining appearing through openings in this metal sheet, having a different aspect and colours in order to produce a decorative aesthetic effect.

Preferably noble materials are used for the inner linings, such as high quality natural or synthetic fabrics, or leather. This then results in the rigid metal sheet giving the general shape of the decorative element, as well as an external aspect resistant to wear, which may be shiny, satin or matt, and the inner lining forming a more flexible and warmer material, of which the nature, the aspect and the colour clearly stand out on the metal.

It is possible to produce notably bracelets, breastpins, ear pendants or chokers, comprising a cut metal sheet forming a rigid structure having a particular curve depending on its function. For example bracelets formed in a strip of rolled metal sheet are produced, having an opening making it possible to pass the wrist in an adjusted manner.

The lining may receive additional elements to ensure in particular the function of fastening or portage, such as a cord or a chain passing around the neck for a choker, or a pin for hooking up a breastpin on an outfit.

For items of jewelry directly in contact with the skin such as bracelets, the more flexible inner lining gives a more pleasant contact on said skin.

Nevertheless, a problem that is posed with this type of decorative element is that with an inner lining fastened in a permanent manner on the metal sheet by different means to ensure a good maintaining as well as a pinning under the metal sheet, it is then not possible to change this lining in a simple and rapid manner.

In addition, a detachment of the lining generally requires the use of specialised tooling, to remove notably tightening screws or rivets, and may cause damage to the elements. The dismantling and reassembly operation may be slow and delicate so as to conserve an impeccable aspect and a finish in order to justify the decorative function.

It is then not possible to produce rapidly variants of the same item of jewelry or decorative element, by changing the lining or the decorative metal sheet, whereas it is sought more and more to personalise fashion accessories to adapt them for example to the clothes worn, to the types of activities planned, or to a need for frequent renewal so as not to repeat a same decoration.

BRIEF SUMMARY OF THE INVENTION

The aim of the present invention is notably to avoid these drawbacks of the prior art and to enable a rapid, discrete and reversible fastening, without added fastening part, of a decorative lining under a rigid structure of a decorative element such as an item of jewelry.

Reversible fastening is taken to mean a fastening that can be done and undone manually without a tool. On the contrary, permanent fastening is taken to mean a fastening requiring a tool to be done or undone (crimping, screwing, bonding, etc.). Thus, a fastening means enabling a reversible manual fastening is qualified, in the present text, as "reversible fastening means".

The present invention proposes to this end a portable decorative element comprising a rigid structure having decorative piercings, receiving on its rear face, in position of use, a lining forming a plate visible through these piercings, capable of being bent in an elastic manner. According to the invention, the rear face of the rigid structure comprises at least two shoulders opposite to each other and against which, in position of use, the edges of the lining are pressed in an elastic and reversible manner in order to apply a tightening of this lining resulting in its pinning against the rear face of the structure.

According to other embodiments, which may be combined together:

- the rigid structure may be made of a metal sheet having decorative piercings;
- the rear face of the rigid structure may be bent and comprise two free ends, the shoulders being arranged at said free ends in order to constitute, in position of use, a means for reversible longitudinal locking of the lining;
- the rear face may further comprise lateral legs for bearing edges of the lining;
- the rear face may further comprise lateral shoulders for bearing edges of the lining;
- the rear face may comprise a cavity of depth less than a thickness of the rigid structure and delimited by a circumferential rim forming shoulder, the cavity being intended to receive the lining such that, in position of use, the edges of the lining are pressed in an elastic and reversible manner against the rim of the cavity in order to apply a tightening of this lining resulting in its pinning against the rear face of the structure;
- a distance between two opposite shoulders, along the contour of the rear face of the structure, may be less than the corresponding distance on the lining so as to ensure its tightening and its pinning against the rear face of the structure by these shoulders;
- the decorative element may constitute a ring comprising a rigid strip bent substantially along an arc of circle, having an opening for the passage of a finger; and/or
- the lining may comprise two faces of different colours, provided to be turned alternately towards the structure.

An advantage of this decorative element is that the shoulders applying a tightening of the lining ensure a stress on this lining making it possible to maintain it without play under the rigid structure and thus without wear, and generate a pressure that tends, when the lining is bent, to push the lining back towards the exterior which results in its pinning on the rear face ensuring the desired aesthetic effect.

Moreover, the fastening means are invisible from the exterior when the item of jewelry is worn. In addition, the shoulders hug the shape of the edges of the lining, they are very discrete even when the item of jewelry is not worn, such that the user does not immediately see how the lining is fastened.

It is then possible, in a simple and rapid manner, without damaging any component, to dislocate the lining in order to remove it and replace it by another. It is also possible to use this lining with another metal structure.

The invention also relates to a decorative kit comprising a preceding decorative element and a plurality of different decorative linings.

BRIEF DESCRIPTION OF THE DRAWINGS

Other characteristics of the invention will be set forth in the description detailed hereafter, made with reference to the appended drawings, which represent respectively.

DETAILED DESCRIPTION OF THE PREFERRED EMBODIMENTS

Figure 1:
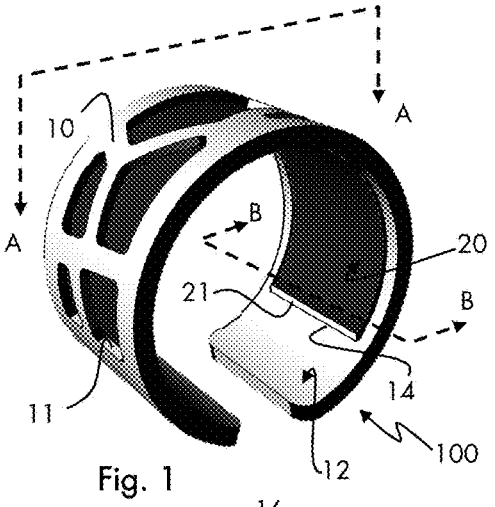
FIG. 1, a schematic view in perspective of a ring forming a decorative element according to the invention.

FIG. 1 shows a ring 100 comprising a rigid structure 10 formed in a strip of metal sheet cut to have decorative piercings 11. The rigid structure 10 is bent to form a loop, closed or not, and having an opening for the passage of a finger. A similar structure could be used to produce a bracelet.

Various metals may be used such as steel, copper, silver, gold, aluminium, or an alloy of one or more of these metals.

Other materials may be used to produce the rigid structure 10, such as for example wood, or a rigid polymer.

The decorative piercings 11 may be obtained by cutting, moulding, or by not edge to edge fastening of solid parts in order to leave empty spaces between them. For example, it is possible to weld the plates together to obtain the rigid openwork structure of the invention.

According to the invention, a lining 20 is pinned inside the metal structure 10 on its rear face 12 and against at least two shoulders 14 borne by the rear face 12. In particular, the shoulders 14 are arranged in an opposite manner along the longitudinal axis of the rigid structure, preferably at the free ends 15 of the structure 10 in order to constitute, in position of use, a means for reversible longitudinal locking of the lining 20.

Figure 2:
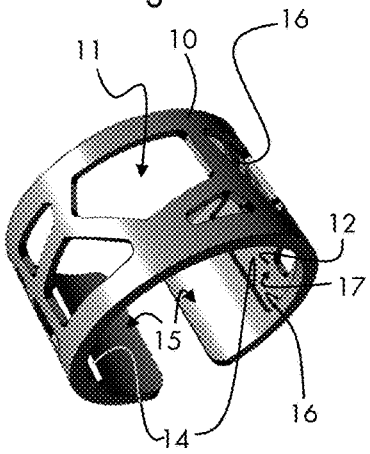
FIGS. 2 and 3, schematic views in perspective showing respectively the rigid structure and the lining of this ring which are detached.
Figure 4:
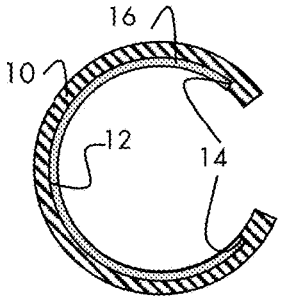
FIG. 4, a schematic view in longitudinal section, along the line A-A of the ring of FIG. 1, of a first embodiment of a ring alone, exempt of lining.

In the embodiment of FIGS. 1, 2 and 4, the rear face 12 also comprises lateral shoulders 16 for bearing the longitudinal edges 22 of the lining 20, forming means for laterally maintaining the lining 20.

More precisely, in this embodiment, the rear face 12 comprises a cavity 17, of shape identical to that of the lining 20 (see FIG. 3), and of depth E0 less than a thickness E of the rigid structure. For example, the rigid structure has a thickness of 1.2 millimeters and the cavity only has a depth of 0.6 millimeters.

The cavity 17 is thus delimited at the bottom by the rear face 12, and laterally by a circumferential rim forming shoulder 14-16. In the numerical example given, these shoulders 14-16 thus measure 0.6 millimeters high.

In other words, the shoulders 14-16 are constituted by the edge with an over-thickness of material compared to the thickness of material within the cavity 17.

Figure 3:
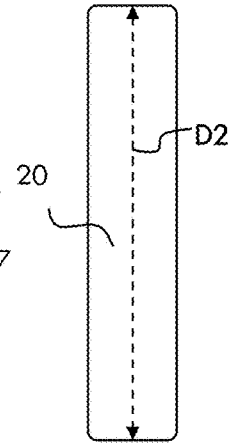

In the embodiment illustrated in FIG. 3, the lining 20 has a substantially rectangular shape.

Figure 10:
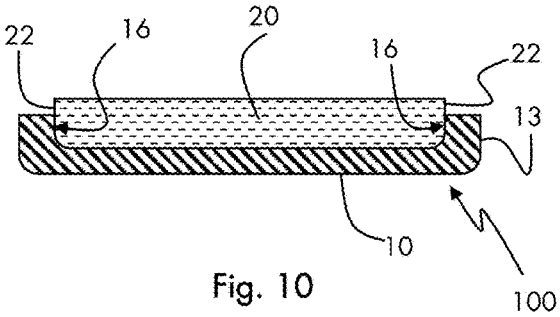
FIG. 10, a schematic view in transversal section along the line B-B of the ring of FIG. 1.

More generally, the dimensions of the cavity 17 and the lining 20 are such that, in position of use, the transversal 21 and longitudinal 22 edges of the lining 20 are forcibly pressed, in an elastic and reversible manner, against the rim 14-16 of the cavity in order to apply a tightening of this lining resulting in its pinning against the rear face 12 of the structure 10. This layout is represented in FIG. 10 which illustrates a transversal section of the ring 100 along the line B-B of FIG. 1.

Similarly, as shown in FIG. 1, the transversal edges 21 bear in an elastic and reversible manner against the two shoulders 14 (only one is visible in FIG. 1) borne by the rear face 12 of the structure 10, which makes it possible to apply a tightening of this lining 20 resulting in its pinning against the rear face 12 of the structure 10.

To ensure the tightening and the pinning of the lining 20 against the rear face 12 of the structure 10 by the shoulders 14, the distance D1 between two opposite shoulders 14, along the contour of the rear face of the rigid structure 10, is just less than the corresponding distance D2 on the lining 20 (see FIG. 3).

Advantageously, the lining is made of leather or comprises two leather faces. The leather faces constitute a material ensuring good durability as well as a pleasant contact with the skin.

Alternatively, the lining may be made of synthetic material, or even made of metal in the form of a metal sheet (titanium steel).

What is important is that the material/thickness combination of the lining enables an elastic and non-plastic bending of the lining.

To do so, the lining must have a shape memory which enables it to recover its shape after bending.

For example, a slightly flexible leather is chosen, having an elasticity with a shape memory that enables it to recover its shape after bending. If necessary, it is possible to produce a stack of leathers assembled together giving a semi-rigidity to the lining, with for example a flexible central core having a thickness of around 1/10 mm. Preferably, the lining comprises two faces of different colours, provided to be turned alternately towards the structure. It is thus possible rapidly, with the purchase of a single lining, to benefit from a decorative element having two different aspects.

Figure 11:
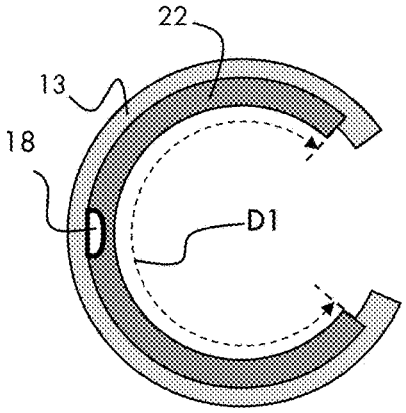
FIG. 11, a schematic side view of an alternative embodiment of means for laterally maintaining the lining.

Alternatively to the lateral shoulders 16 hollowed out in the thickness of the rigid structure, the rear face 12 may support, as illustrated in FIG. 11, lateral legs 18 for bearing edges of the lining 20, thereby constituting one-off means for laterally maintaining (and not continuous as in FIGS. 1 and 2) the lining 20. These lateral legs 18 may be constituted advantageously by the folding of the metal sheet of the rigid structure.

These means for laterally maintaining the lining enable a precise maintaining in position of the lining while preventing the lining from sliding outside of the rigid structure under the effect of movements of the user.

However, in certain cases (for example when it is a ring), these means for laterally maintaining are not strictly necessary (the ring moves little because it is generally well adjusted on the finger).

Thus, the rear face 12 may comprise no lateral shoulder 16 and no lateral leg 18.

Figure 5:
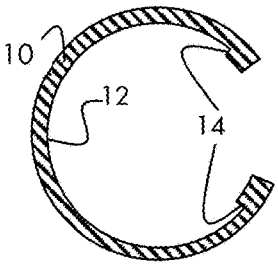
FIG. 5, a schematic view in longitudinal section of a second embodiment of a ring alone, exempt of lining.

This embodiment is illustrated in longitudinal section in FIG. 5. The lining 20 (not illustrated in this figure) is then only maintained along the longitudinal direction by the shoulders 14.

In this case, the longitudinal edges 22 of the lining 20 are advantageously flush with the lateral edges 13 of the rigid structure 10 when the lining is pinned inside the metal structure 2 on its rear face.

Thus, in a general manner, according to the invention, the lining 20 forms a plate that may be bent in an elastic manner, bearing constrained inside the structure 10 on two shoulders 14 each arranged in the longitudinal axis of the strip, near to one end of this strip.

Thus, in use, the lining can bulge out and be forcibly applied elastically against the rigid structure by jamming between the shoulders 14.

In other words, the lining 20 is braced on the shoulders 14 and against the rear face 12 of the rigid structure 10.

More generally, the transversal shoulders 14 (and the lateral shoulders 16 or the lateral legs 18 when they are present) apply a tightening of the lining 20, which applies a stress on the lining making it possible to maintain it without play in the structure and thus without wear, and generate a pressure which tends to bend it and to push it back towards the metal structure, which results in its pinning on the rear face ensuring the desired aesthetic effect.

Figure 6:
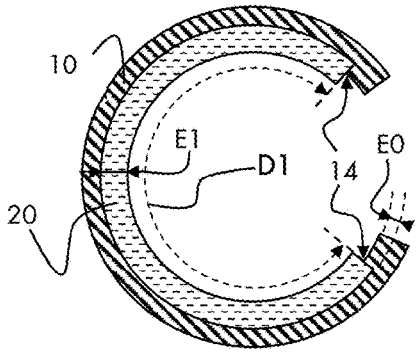
FIGS. 6 to 8, schematic views in longitudinal section of three embodiments of rings provided with linings of different thicknesses.
Figure 7:
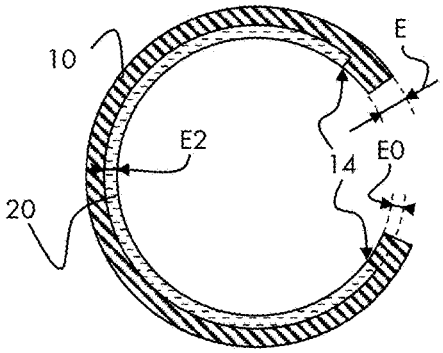
Figure 8:
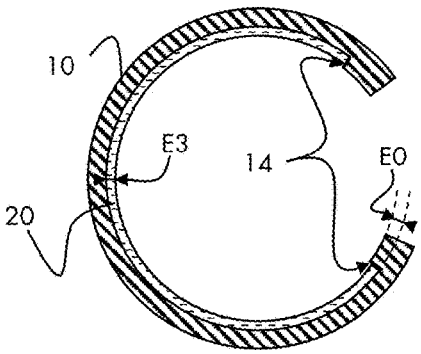

FIGS. 6, 7 and 8 illustrate three embodiments in which the thickness of the lining differs.

In FIG. 6, the lining 20 has a thickness E1 greater than the height E0 of the shoulders 14.

For example, the metal sheet of the structure 10 has a thickness of around 1 to 2 millimeters, the shoulders 14 a height E0 of 0.6 millimeters, and the lining made of leather 20 a thickness E1 greater than 0.6 millimeters and may go up to around 1 to 2 millimeters. A too great over-thickness of the lining compared to the shoulders risks being uncomfortable when it is a ring.

In FIG. 7, the lining has a thickness E2 equal to the height E0 of the shoulders 14 and in FIG. 8 the lining has a thickness E3 less than the height E0 of the shoulders 14.

In all cases, the bearing of the lining against the shoulders 14 enables its pinning against the rigid structure 10 and its maintaining in place.

Figure 9A:
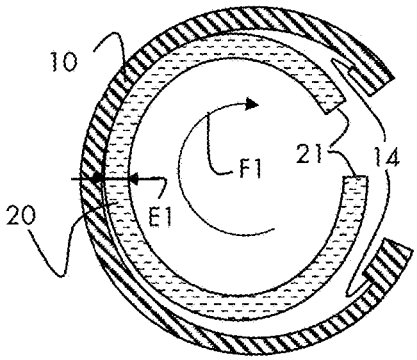
FIGS. 9*a* to 9*c*, schematic views in section showing the assembly of the lining under the rigid structure.
Figure 9B:
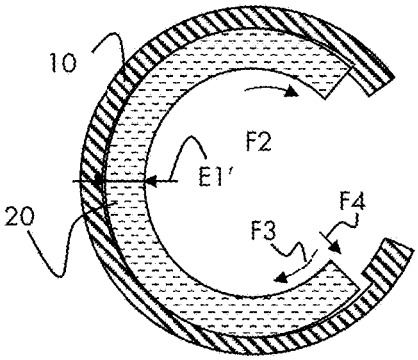
Figure 9C:
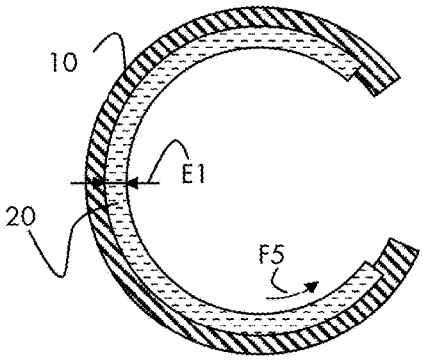

FIGS. 9*a* to 9*c* show the method for assembling the lining 20 under the rigid structure 10, here a ring.

FIG. 9*a* firstly shows the shaping of the lining 20, which is bent and rolled in the direction of the arrow F1 in order to have a diameter slightly less than that of the structure 10 arranged below.

The lining 20 is then lowered vertically by axial sliding, by sliding it into the structure 10 and one of the ends of the lining 20 is brought into abutment against a shoulder 14 in the direction of the arrow F2 (FIG. 9*b*).

If needs be, the lining 20 is also adjusted between the two transversal shoulders 18, which form a transversal lateral wedging.

The lining having a length D2 just greater than the length D1 between two shoulders 14, along the contour of the rear face of the rigid structure 10, the user slightly compresses the lining 20 in the direction of the arrow F3 (which has the effect of increasing slightly its thickness from E1 to E1'; see FIG. 9*b*), then the user applies a pressure F4 inside the lining 4 in order to engage the second end of the lining against the second shoulder 14 in the direction of the arrow F5 (FIG. 9*c*). In this way, the lining recovers its thickness E1.

By providing a distance D2 between the two edges of the lining 20 slightly greater than the distance D1 available between the two shoulders 14 along the curvature of the structure, this produces a certain longitudinal pressure of this lining 20 in the rigid structure 10 ensuring a maintaining and an absence of play while generating a longitudinal tightening (and potentially transversal in the case of transversal shoulders 16 or lateral legs 18) and a pinning of the lining against the rear face of the structure by these shoulders.

In addition, the slightly elastic shape memory of the lining 20 tends to maintain its distancing inside the structure 20, which reinforces its pinning in this structure. The simple and rapid mounting of the lining 20, without tooling, ensures an efficient positioning that is maintained over time.

An item of jewelry (ring or bracelet) is obtained having at the same time the shiny and luminous aspect of the metal structure 10, giving by its stiffness the general shape of the item of jewelry, embellished with piercings 11 through which appear the lining made of leather 20 providing colour and softness. In particular it is possible to choose a particular relief of the leather giving a luxurious aspect to the item of jewelry. The combination of two different technologies, of metal embellished with cuts having a metallic glitter and the leather of the lining, stemming from the know-how of two different trades, gives a contrast providing a particular modern aesthetic.

The dismantling of the lining 20 takes place simply, either by pushing on one of its ends to dislocate it out of the corresponding shoulder 14, or by pushing it from the outer face of the rigid structure 10, through the decorative orifices 11. This pushing may take place either with a finger or with a push rod according to the size of the decorative orifices.

It will be noted that this dismantling takes place without modifying or damaging any part.

Advantageously, two different colours are available on the two faces of the lining 20 that is reversible, which enables from a same lining mounted in one direction or in the other to obtain two different effects on the same item of jewelry.

In a variant, it is possible to produce a lining 20 having a surface formed by other materials, such as natural or synthetic fabric, or a plastic material. If necessary, a stack of materials is produced comprising therein a plate having elasticity to ensure bending and a shape memory.

It is thus possible to produce a lining 20 which juts out in places on the sides of the structure, in order to be visible and to give a particular aesthetic.

It is possible to provide an individual sale of the linings 20 separate from the rigid structures 10, which then makes it possible to have available at a reduced cost a wide choice of aspects and colours. It is also possible to remove the lining 20, in order to wear uniquely the metal structure 10 which gives an additional presentation variant. The fact that the shoulders are almost invisible makes the use of the rigid structure alone pleasant (without risk of scratching with a button hole type fastening means) and discrete (the fastening means do not appear when seen from the exterior).

It is also possible to sell advantageously a decorative kit suited to each rigid structure (a bracelet, a ring), and comprising a plurality of aesthetically different linings 20 and a decorative element according to the invention.

The discretion of the shoulders and their maintaining efficiency also makes it possible to reduce the thickness of the rigid structure 10, which allows the creation of more detailed patterns.

The cuttings of the rigid structure 10 may be also combined with stampings or engravings on the metal surface of the metal sheet, to bring other decorative effects, such as writing. The structure 10 has a surface that may be polished, satin or matt, comprising a metal or a coating comprising good mechanical strength as well as a resistance to oxidation and to chemical agents so as to conserve its aspect without wear and without alteration. It is possible in particular to produce a coating made of gold, silver, ruthenium, palladium or rhodium.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

The invention claimed is:

1. Decorative element comprising a rigid structure having decorative piercings, receiving on a rear face of the rigid structure, in position of use, a lining forming a plate visible through these piercings, capable of being bent in an elastic manner, wherein the rear face of the rigid structure comprises at least two transversal shoulders arranged in an opposite manner along the longitudinal axis of the rigid structure and lateral shoulders for bearing the longitudinal edges of the lining and forming means for laterally maintaining the lining and against which, in position of use, the edges of the lining are pressed in an elastic and reversible manner against the transversal shoulders and lateral shoulders in order to apply a tightening of this lining resulting in the lining pinning against the rear face of the structure.

2. Decorative element according to claim 1, in which the rigid structure is made of a metal sheet having decorative piercings.

3. Decorative element according to claim 1, in which the rear face of the rigid structure is bent and comprises two free ends, the transversal shoulders being arranged at said free ends in order to constitute, in position of use, a means for reversible longitudinal locking of the lining.

4. Decorative element according to claim 1, in which the rear face further comprises lateral legs for bearing edges and laterally maintaining the lining.

5. Decorative element according to claim 4, in which the rear face comprises a cavity of depth (EO) less than a thickness (E) of the rigid structure and delimited by the lateral shoulders for bearing the longitudinal edges of the lining and the transversal shoulders, the cavity being intended to receive the lining such that, in position of use, the edges of the lining are pressed in an elastic and reversible manner against the lateral shoulders and the transversal shoulders of the cavity in order to apply a tightening of this lining resulting in the lining pinning against the rear face of the structure.

6. Decorative element according to claim 1, in which a distance (D1) between the two opposite transversal shoulders, along the contour of the rear face of the structure, is less than the corresponding distance (D2) on the lining so as to ensure the lining tightening and the lining pinning against the rear face of the structure by these transversal shoulders.

7. Decorative element according to claim 1, wherein the rigid structure constitutes a ring comprising a rigid strip bent substantially according to an arc of circle, having an opening for the passage of a finger.

8. Decorative element according to claim 1, in which the lining comprises two faces of different colours, provided to be turned alternately towards the structure.

9. Decorative kit comprising a decorative element according to claim 1 and a plurality of different decorative linings.

10. Decorative element comprising a rigid structure having decorative piercings, receiving on a rear face of the rigid structure, in position of use, a lining forming a plate visible through these piercings, capable of being bent in an elastic manner, wherein the rear face of the rigid structure comprises at least two transversal shoulders arranged in an opposite manner along the longitudinal axis of the rigid structure and against which, in position of use, the edges of the lining are pressed in an elastic and reversible manner in order to apply a tightening of this lining resulting in the lining pinning against the rear face of the structure, the rear face further comprises lateral shoulders for bearing the longitudinal edges of the lining and forming means for laterally maintaining the lining, the rear face comprises a cavity of depth (EO) less than a thickness (E) of the rigid structure and delimited by the lateral shoulders for bearing the longitudinal edges of the lining and the transversal shoulders, the cavity being intended to receive the lining such that, in position of use, the edges of the lining are pressed in an elastic and reversible manner against the lateral shoulders and the transversal shoulders of the cavity in order to apply a tightening of this lining resulting in the lining pinning against the rear face of the structure.

11. Decorative element according to claim 10, in which the rigid structure is made of a metal sheet having decorative piercings.

12. Decorative element according to claim 10, in which the rear face of the rigid structure is bent and comprises two free ends, the transversal shoulders being arranged at said free ends in order to constitute, in position of use, a means for reversible longitudinal locking of the lining.

13. Decorative element according to claim 10, in which the rear face further comprises lateral legs for bearing edges of the lining.

14. Decorative element according to claim 10, in which a distance (D1) between the two opposite transversal shoulders, along the contour of the rear face of the structure, is less than the corresponding distance (D2) on the lining so as to ensure the lining tightening and the lining pinning against the rear face of the structure by these transversal shoulders.

15. Decorative element according to claim 10, wherein the rigid structure constitutes a ring comprising a rigid strip bent substantially according to an arc of circle, having an opening for the passage of a finger.

16. Decorative element according to claim 10, in which the lining comprises two faces of different colours, provided to be turned alternately towards the structure.

17. Decorative kit comprising a decorative element according to claim 10 and a plurality of different decorative linings.

* * * * *